US007108151B2

(12) United States Patent
Higuchi

(10) Patent No.: US 7,108,151 B2
(45) **Date of Patent: *Sep. 19, 2006**

(54) CONTAINER CAPABLE OF KEEPING A LENGTHWISE CONTRACTED STATE AND CONTRACTION METHOD THEREOF

(75) Inventor: Mitsuo Higuchi, Yamanashi (JP)

(73) Assignee: Gohsho Company, Limited, Yamanashi (JP)

( * ) Notice: Subject to any disclaimer, the term of this patent is extended or adjusted under 35 U.S.C. 154(b) by 440 days.

This patent is subject to a terminal disclaimer.

(21) Appl. No.: 10/624,552

(22) Filed: Jul. 23, 2003

(65) Prior Publication Data

US 2005/0017015 A1 Jan. 27, 2005

(51) Int. Cl.
*B65D 6/08* (2006.01)
*B65D 8/04* (2006.01)
*B65D 90/02* (2006.01)

(52) U.S. Cl. ..... 220/666; 215/381; 215/900

(58) Field of Classification Search ..... 220/666; 215/900, 381, 382; 222/92, 95; 206/218
See application file for complete search history.

(56) References Cited

U.S. PATENT DOCUMENTS 5,584,413 A * 12/1996 Jung ..... 220/666
6,662,964 B1 * 12/2003 Higuchi ..... 220/667

FOREIGN PATENT DOCUMENTS

FR 2607109 A1 * 5/1988

OTHER PUBLICATIONS

English translation of abstract for FR 2607109 A1.*

* cited by examiner

*Primary Examiner*—Nathan J. Newhouse
*Assistant Examiner*—Harry Grosso
(74) *Attorney, Agent, or Firm*—Reed Smith LLP; Stanley P. Fisher, Esq.; Juan Carlos A. Marquez, Esq.

(57) ABSTRACT

To extremely reduce the capacity of a container body when juice or mineral water in a container body is drunk up and the container body is discarded. The container body includes: a top tap; a small width in a height direction at a bottom; and a horizontal bellows formed on the whole or part in a longitudinal direction of the container body, except the top tap, and the width in the height direction.

6 Claims, 14 Drawing Sheets

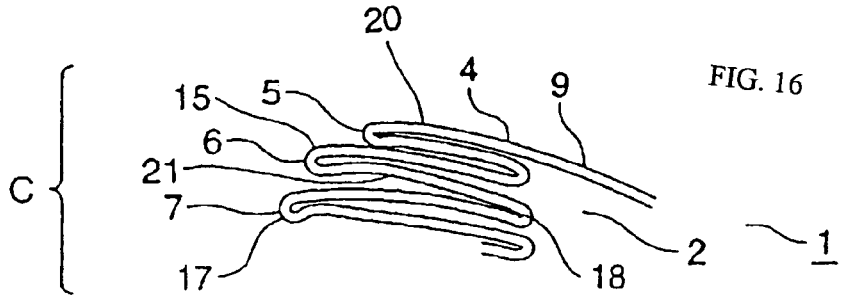
FIG. 16
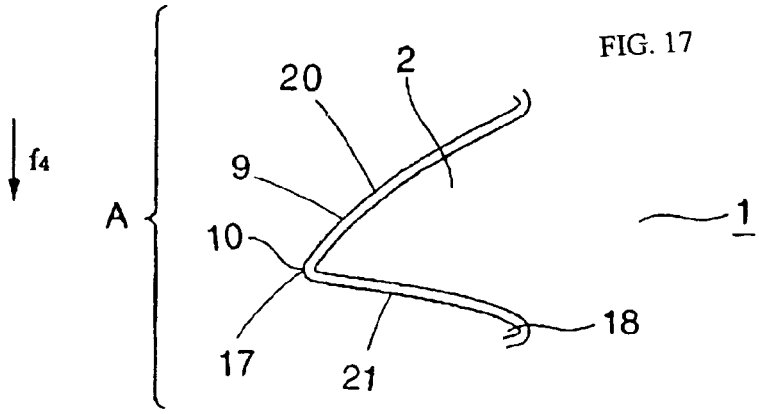
FIG. 17
FIG. 18
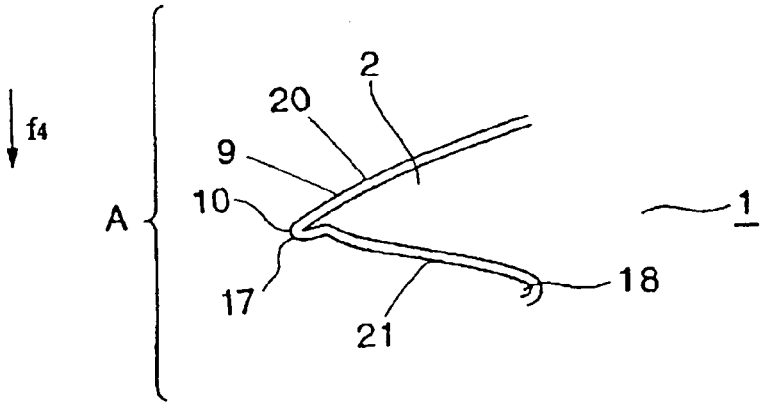

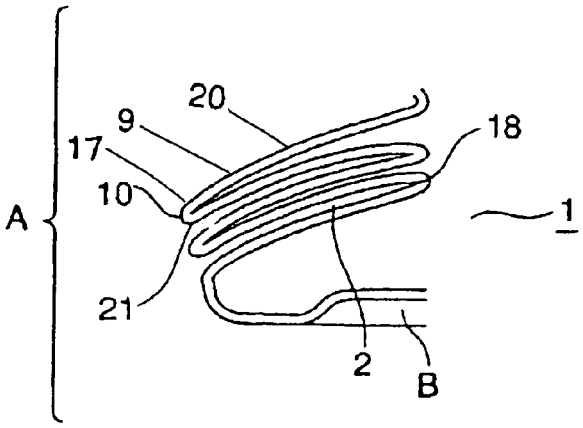
FIG. 19
FIG. 20
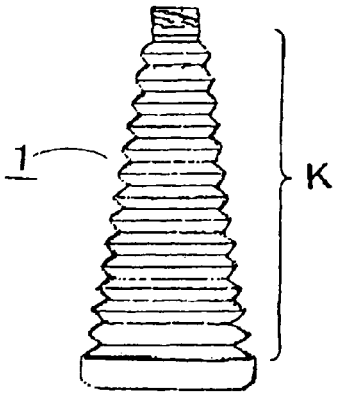
FIG. 21
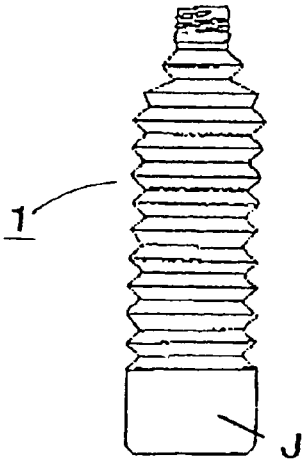

CONTAINER CAPABLE OF KEEPING A LENGTHWISE CONTRACTED STATE AND CONTRACTION METHOD THEREOF

BACKGROUND OF THE INVENTION

1. Field of the Invention

The present invention relates to a container for juice or mineral water formed by a blow molding method or the like, which is referred to as stretch blow molding, injection blow molding, or generally PET blow molding, and more particularly to a container whose lengthwise size can be reduced (capacity can be reduced) after the content is drunk up and the contraction method thereof.

2. Description of the Related Art

Production of synthetic resin bottles has been considerably increasing in recent years. However, after juice or mineral water in a container body is drunk up, the container body is discarded with a shape thereof remaining as before drinking up. When the container body is discarded in a trash can, the trash can is soon filled as if air were discarded therein, and finally the container body is left on a road, deteriorating life environments. In addition, costs for collecting drained container bodies and labor costs for cleaning place a heavy burden on public works.

Although this kind of synthetic resin bottle can be manufactured by simple means such as blow molding, it cannot sufficiently resist strong vibrations of automobiles or other transportation means or stacking for display at a store.

Furthermore, while the container is transported from a container manufacturer to a bottler of juice or mineral water, the container body is bulky as if air were transported, requiring considerably high costs for transporting the product.

Thus, the inventor of the application has suggested a liquid container that can be easily contracted when drained and collected. The liquid container is made of relatively soft synthetic resin, and a body thereof has a bellows peripheral wall with a top tap (Japanese Patent Laid-Open No. 2001-213418, Abstract).

In addition, the inventor has suggested applying a load on a container body in a perpendicular direction and/or a twisting direction to cause contraction of the capacity, means for keeping the contracted shape, and the container body (Japanese Patent Laid-Open No. 2002-68156, Abstract). However, both of the above suggestions cannot achieve a reduced height and sufficient contraction of the container to keep the contracted state when the container body is collapsed.

SUMMARY OF THE INVENTION

Generally, an object of the invention is to extremely reduce the capacity of a container body when juice or mineral water in the container body is drunk up and the container body is discarded, and to increase the number of empty container bodies received by a trash can, compared to the related art. This allows transportation of the empty container bodies in large number at the same time. Thus, another object of the invention is to extremely reduce collection costs and labor costs for cleaning and collection.

A further object of the invention is to extremely increase the number of transported containers per transportation, compared to the related art, when the container is transported from a container manufacturer to a bottler of juice or mineral water.

The object of the present invention is, as described above, to extremely reduce the capacity of the container body when the drained container body is discarded or transported. A contracted shape of the container body is kept for a long time, or for a long term, or until crushing, fusion or other operations for recycling, without any restoring force applied to the container body.

The overall shape of the container body according to the invention is selected from columns including elliptical ones, prisms including rectangular ones, and cones and pyramids including truncated ones, and the horizontal cross sectional shape of the container body is selected from circles including ellipses, and squares including rectangles.

A further object of the invention is to increase an area on the container body to which a label with an explanation of the content of the container or a trademark printed is affixed, or on which an explanation or a trademark is directly printed, compared to the related art.

When used as a beverage container, the container body according to the invention has a good appearance to attract much interest of a user, and can be prevented from slipping and falling in use, or the content can be prevented from overflowing. For this purpose, there are provided a container capable of keeping a lengthwise contracted state and a contraction method thereof.

A feature of the invention is that a container body includes: a top tap; a small width in a height direction at a bottom; and a horizontal bellows formed on the whole or part in a longitudinal direction of the container body, except the top tap, and the width in the height direction.

When the bellows of the container is pressed longitudinally from both sides thereof toward a center, the bellows is collapsed to overlap, a connection between the top tap and the container body is bent to place the tap in the overlapping bellows, and this state is kept.

Another feature of the invention is that a container body includes: a top tap; a small width in a height direction at a bottom; a flat portion in a middle portion; and a horizontal bellows formed on the whole or part in a longitudinal direction of the container body, except the tap, the width in the height direction, and the flat portion.

When the bellows of the container is pressed longitudinally from both sides thereof toward a center, the bellows is collapsed to overlap, a connection between the top tap and the container body is bent to place the tap in the overlapping bellows and/or the flat portion, and the width in the height direction at the bottom of the container body is placed in the bent and overlapping bellows and/or the flat portion, and this state is kept.

The technical scope of the invention includes a further feature that the bellows of the container body has one diameter smaller than the other, with a diameter gradually increasing toward the other end to be a diameter equal to that in a lower portion, and includes a contraction method of a container capable of keeping a lengthwise contracted state, wherein a force is perpendicularly applied to the bellows of the container body, and a force is applied that presses, in one direction, an inner periphery of a piece of fold and/or part of folds that constitute the bellows, causing a force in an opposite direction to be applied to an outer periphery to keep a lengthwise contracted bellows.

The technical scope of the invention includes further features that the overall shape of the container body is selected from columns including elliptical ones, prisms including rectangular ones, cones and pyramids including truncated ones, hourglass dram shaped, and barrels; the horizontal cross sectional shape of the container body is selected from circles including ellipses, and squares including rectangles; and a label with an explanation of the content of the container or a trademark printed is affixed to the outer periphery of the container body.

The technical scope of the invention includes a container body including: a tap protruding upward from a center of a top; and horizontal bellows formed on inner and outer walls of the whole or part in a length (height) direction of the container body, except the tap, wherein the bellows has an upper diameter smaller than a lower diameter with a diameter gradually increasing toward a lower portion; when a force is perpendicularly applied to the bellows of the container body, the force acts downwards in an inner diameter direction and upwards in an outer diameter direction of upper folds of the bellows, and the force acts upwards in an inner diameter direction and upwards and downwards in an outer diameter direction of lower folds of the bellows to keep a lengthwise (height) contracted bellows of the container body; and when the container body is carried or held after part of, for example, juice is drunk, the container body can be contracted depending on the amount of drunk juice, and the capacity of the container body to be carried or stored can be reduced by the amount.

The invention has other outstanding objects, features, and advantages, and they will become apparent from the following descriptions of the embodiments.

BRIEF DESCRIPTION OF THE DRAWINGS

FIG. 16 shows a deformed state of a shoulder when the container body is collapsed, and a completion stage of pressing;

FIG. 17 shows a deformed state of a middle barrel when the container body is collapsed, and an early stage of pressing;

FIG. 18 shows a deformed state of a middle barrel when the container body is collapsed, and a middle stage of pressing;

FIG. 19 shows a deformed state of a middle barrel when the container body is collapsed, and a completion stage of pressing;

FIG. 20 shows an example where the container body is in a truncated cone shape;

FIG. 21 is a front view of the container body, and shows an example where a surface for a label is provided;

DETAILED DESCRIPTION OF THE PREFERRED EMBODIMENTS

Now, embodiments of the invention will be described with reference to the drawings.

Figure 1:
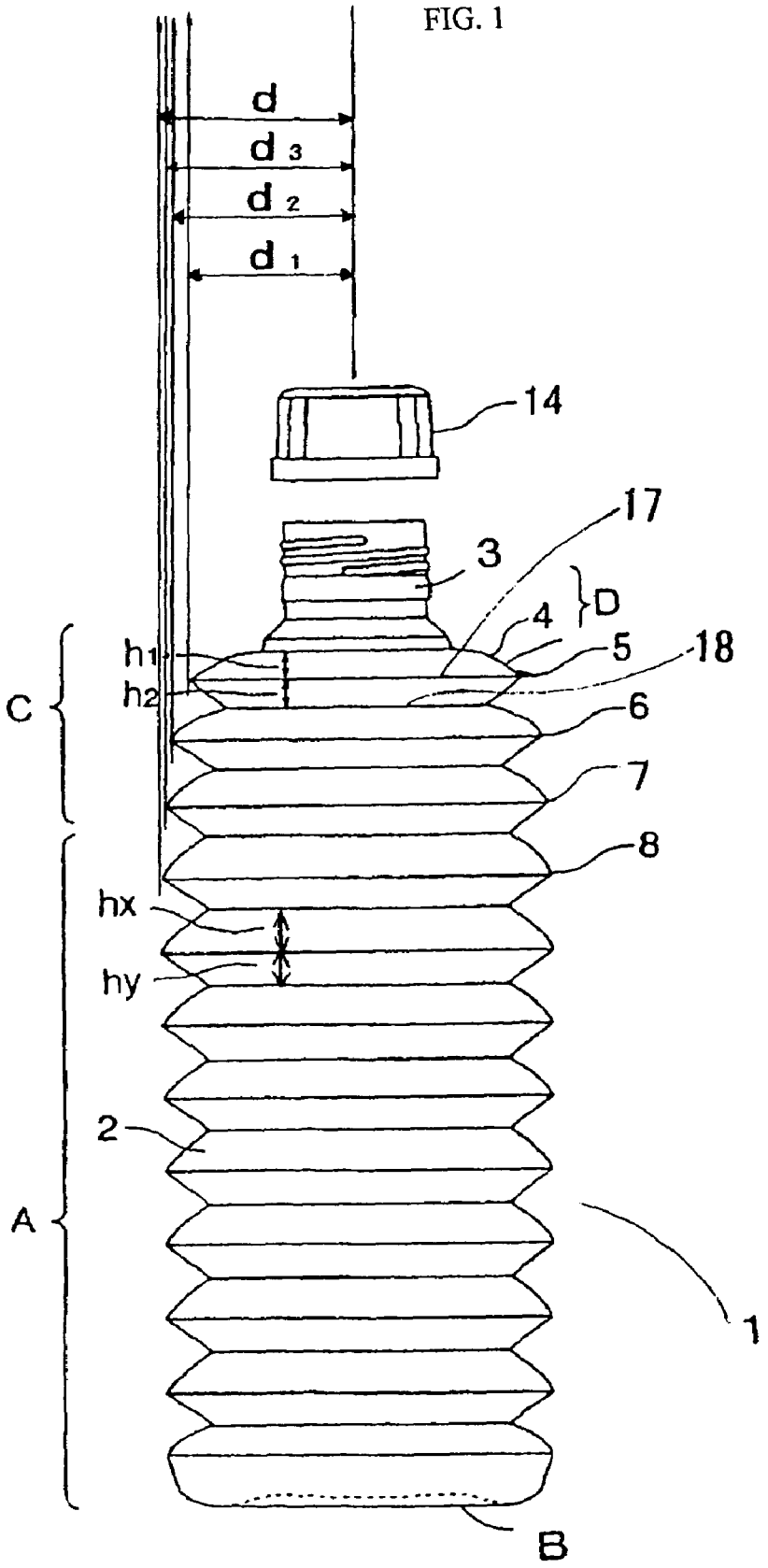
FIG. 1 is a front view of an entire container body according to an embodiment of the invention.
Figure 2:
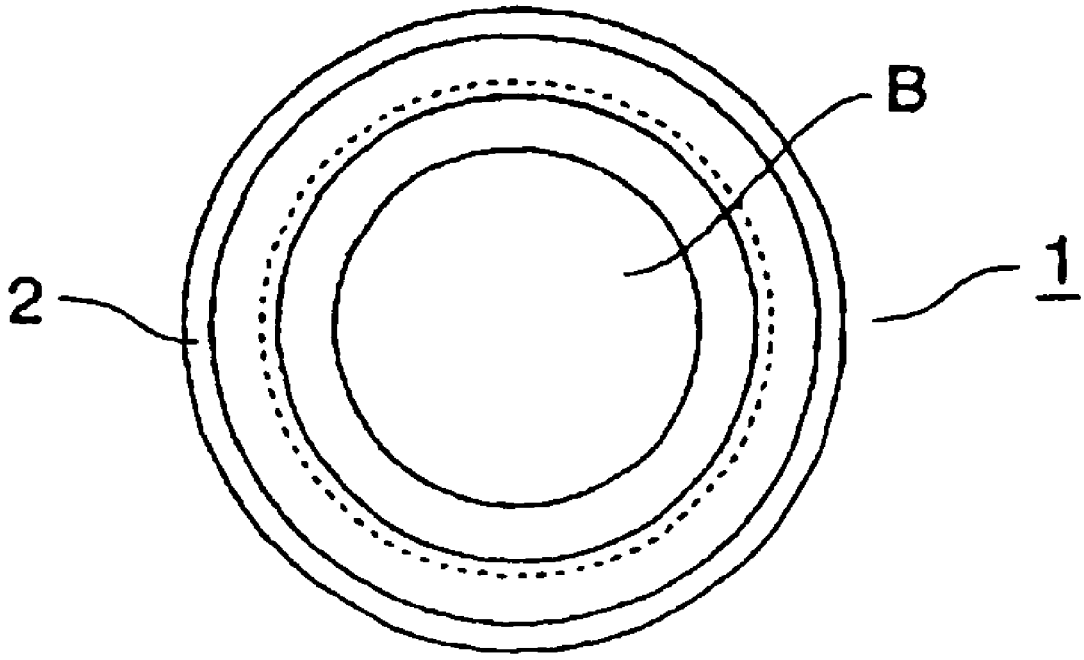
FIG. 2 is a bottom view of the entire container body according to the embodiment of the invention.

In FIG. 1, reference numeral 1 denotes a container body, and a bellows 2 is formed on outer and inner peripheries in a height (length) direction of the container body.

(Embodiment 1)

Figure 3:
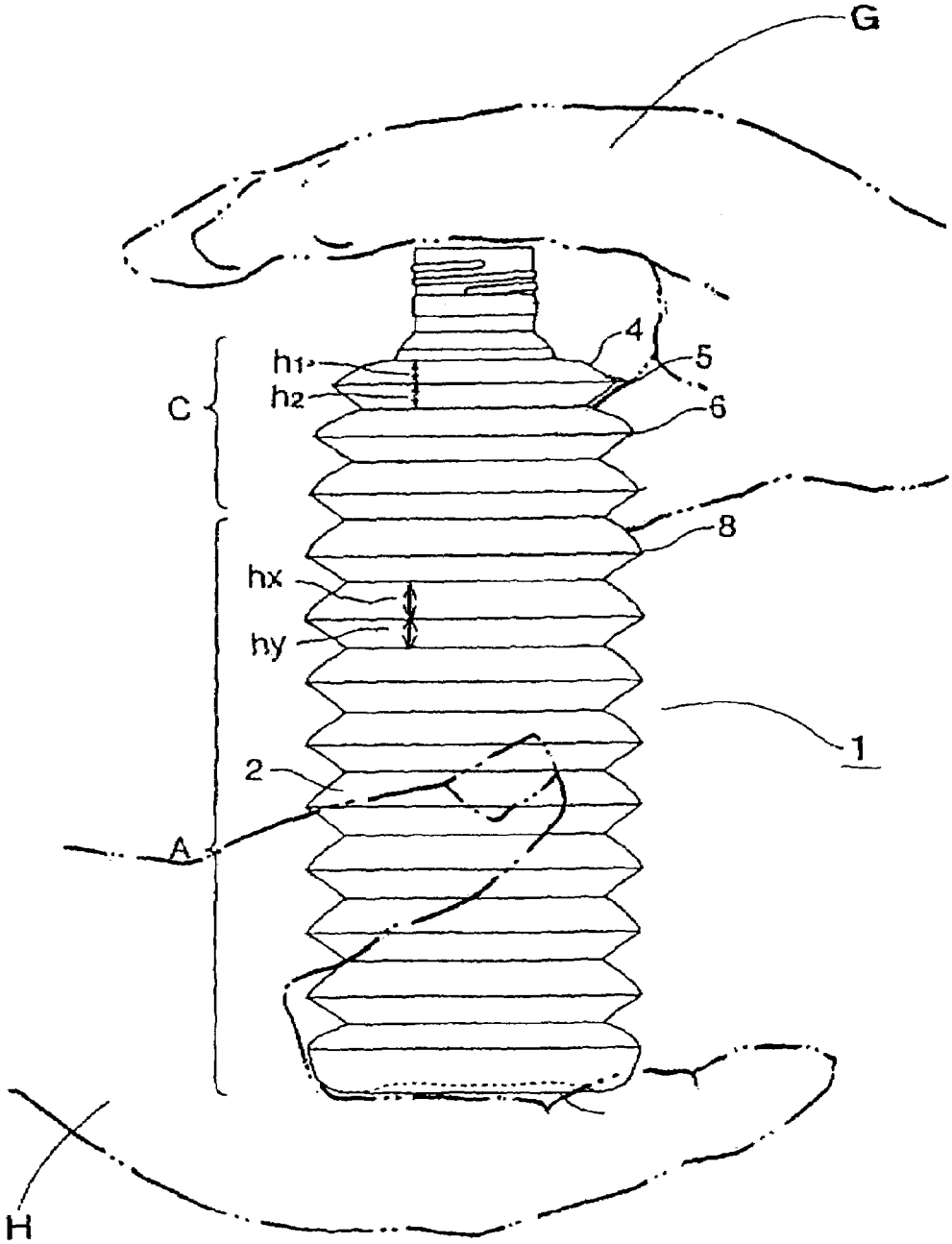
FIG. 3 is a front view of a state where the container body is drained and to be collapsed.
Figure 6:
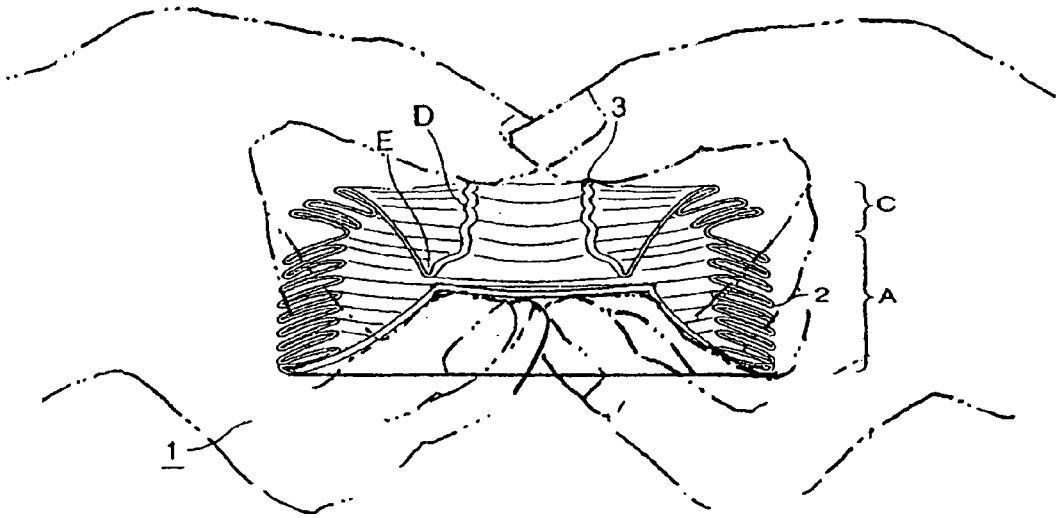
FIG. 6 is a sectional view of a state where the container body has been collapsed.

FIGS. 3 and 6 show a state where, for example, mineral water in the container body 1 is drunk up, and then the container body 1 is collapsed from one side or both sides in the height (length) direction. Specifically, the container body 1 is collapsed and the collapsed state is kept, thus the invention has an excellent configuration and produces excellent effects.

Figure 11:
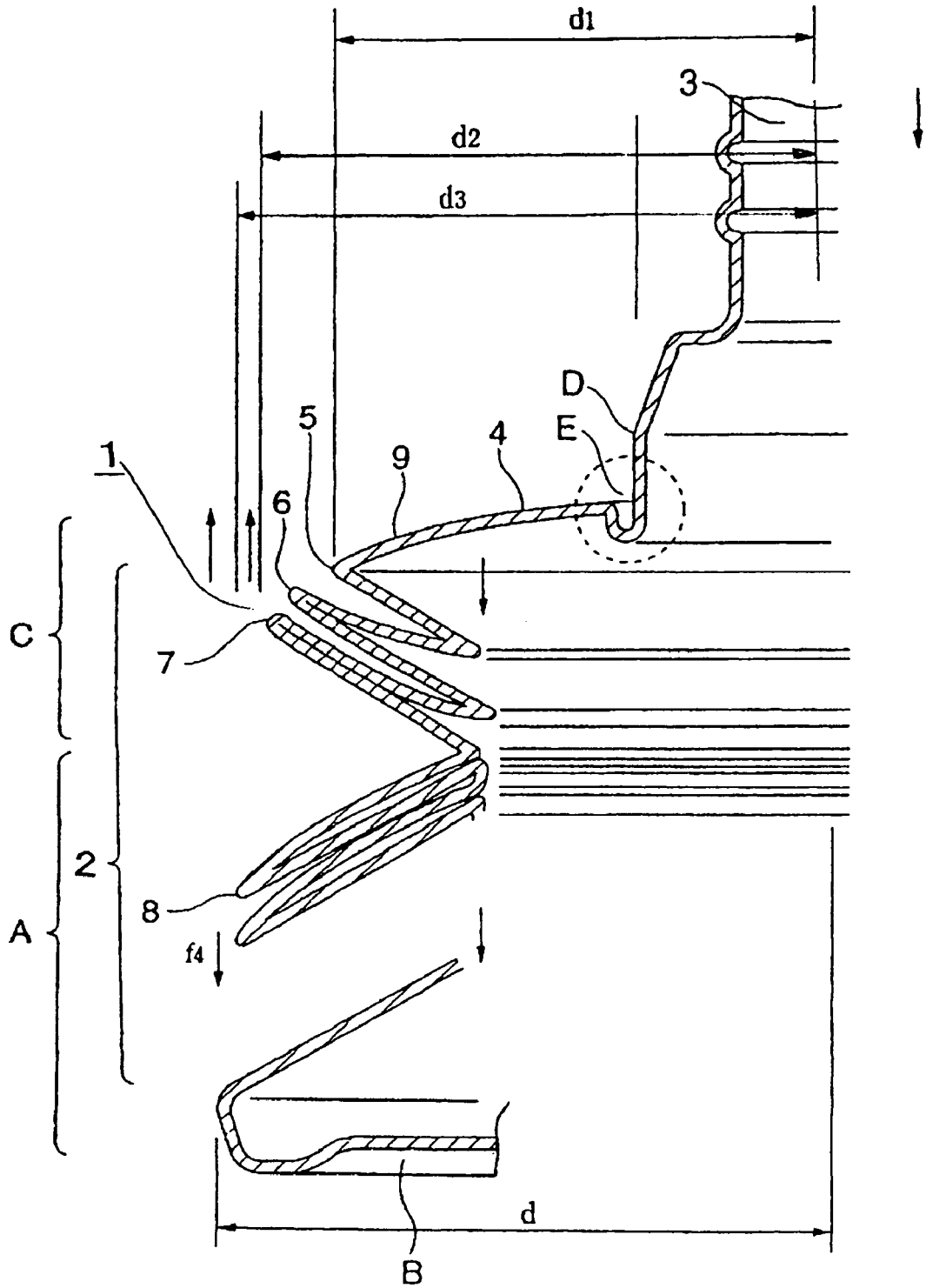
FIG. 11 is a sectional view, partially broken away, of the collapsed container body.
Figure 12:
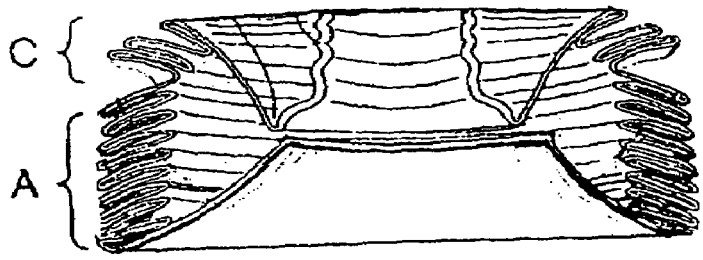
FIG. 12 is a sectional view of the entire collapsed container body.

As an example of the configuration of the container, as seen from FIG. 11, reference numeral 3 denotes a tap of the container body 1, with a thread on a periphery thereof, having an about 28 mm diameter and a 23 mm height. Immediately below the tap 3, a trumpet-shaped connection D having an enlarged lower diameter of about 51 mm and a 5 to 10 mm height is connected to an axis of the tap 3. In a shoulder C of the container body 1, a U-shaped annular groove E with a horizontal inner end is provided, and an end of the trumpet-shaped connection D and an inner side of the annular groove E are connected. An outer side of the U-shaped groove E is in a dome shape 4 toward a lower portion, and an outer radius d1 of a first fold 5, that is, an outer radius d1 of an uppermost fold of the bellows 2 has a smaller radius than an outer radius d of the container body 1. An outer radius d2 of a second fold 6 is larger than the outer radius d1 of the first fold 5, and smaller than the outer radius d of the container body 1.

An outer radius d3 of a third fold 7 is larger than the outer radius d2 of the second fold 6, and smaller than the outer radius d of the container body 1, and connects to the second fold 6 to form a staircase shape as viewed from the side. In the shown embodiment, three steps are provided, but of course, the number of steps is not limited to three, and any plurality of steps may be provided.

The container body 1 in FIG. 1 has a 195 mm height, a 71.5 mm maximum diameter, and a 500 ml capacity, and has a wall with 12 steps.

The outer radius d1 of the first fold 5 is 30.25 mm, the outer radius d2 of the second fold 6 is 33.95 mm, and an inner diameter between the first fold 5 and the second fold 6 is 47 mm.

The outer radius d3 of the third fold 7 is 34.85 mm, and an inner diameter between the second fold 6 and the third fold 7 is 51.1 mm. An outer radius d of a fourth fold 8, which is the maximum outer radius of the container body 1, is 35.75 mm, and an inner diameter between the third fold 7 and the fourth fold 8 is 54.5 mm. Each of fifth to twelfth folds has the same radius as the outer radius d of the fourth fold 8, and an inner diameter between each of them is the same as that between the third fold 7 and the fourth fold 8.

In this case, each fold has a shape like an unidentified flying object (UFO) called an Adamski shape, and is horizontally divided into an upper side and a lower side. In the drawing, the heights of the upper side (h1) and the lower side (h2) of the first fold are 6.5 mm and 5.5 mm, those of the second fold are 7 mm and 5 mm, and those of the third fold are 8.5 mm and 6.5 mm.

The bellows includes (1) an upper group of folds 5, 6, 7 increasing gradually in diameter connecting with each other (each upper-group fold 5–7 having an upper side thereof connected with a lower side thereof with an outside periphery there between), and (2) a lower group of folds 8, etc, maintaining an identical radius d and connecting with each other (each lower-group fold having an upper side thereof connected with a lower side thereof with an outside periphery there between). A first lower-group fold 8 has an upper side thereof connected with a lower side of a last upper-group fold 7. The identical radius d of the lower-group folds is longer than the radii of the upper-group folds (d>d3>d2>d1). The folds are so formed that forces along the longitudinal direction applied to the top tap 3 and the bottom B reaches a balance that outside peripheries of the upper-group folds 5–7 are raised upward and the outside peripheries of the lower-group folds 8+ are collapsed downward.

Figure 13:
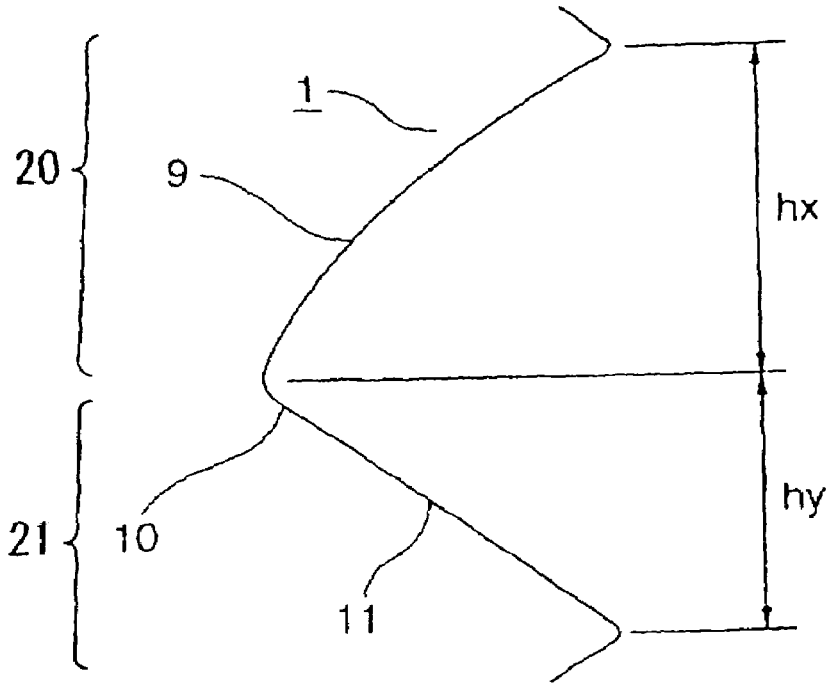
FIG. 13 is an enlarged sectional view of folds that constitute the container body.
Figure 14:
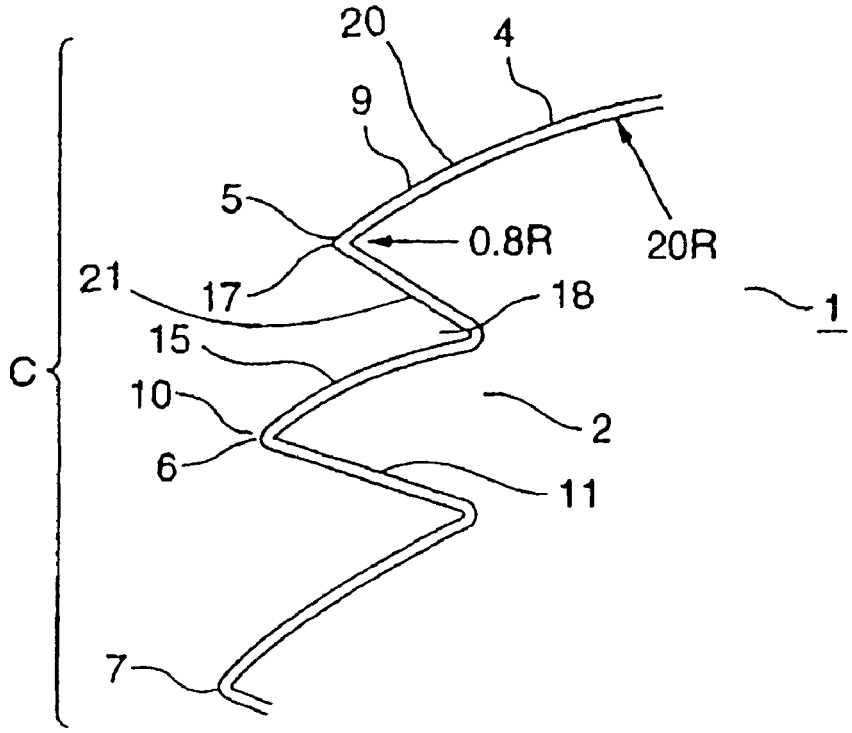
FIG. 14 shows a deformed state of a shoulder when the container body is collapsed, and an early stage of pressing.

FIG. 13 shows a sectional shape of the fold in detail. Specifically, as examples of dimensions of the first fold 5 to the third fold 7, an upper surface 20 of a wide double cone shape forms a curve 9 of 20 mmR in this embodiment where the upper surface protrudes outwards, while a lower surface 21 forms a line 11 via a protruding arc 10 of 0.8 mmR, which is significant.

The configuration of the embodiment together with the effects will be now described. The container body 1 in FIG. 1 is divided into a barrel A including a middle portion and a lower portion, and an upper shoulder C, and each of the barrel A and the shoulder C has two, large and small diameters to keep a stable vertical state.

Specifically, the folds having the same inner and outer diameters are formed on the barrel A including the middle portion and the lower portion, the shoulder C is curved to form a gentle protrusion toward the tap 3, and in the shoulder C, an inner diameter of a trough 18 that forms the fold is gradually reduced from the middle portion toward the tap 3, and the inclination of the trough 18 is larger than that in the barrel A. Thus, in a state where the middle portion is extended, the inner diameter and a slope of a crest 17 and the trough 18 that form the fold can be kept in an extended state by material's own strength and elasticity. A bottom B is recessed with a sharp slope to naturally improve stability.

Figure 4:
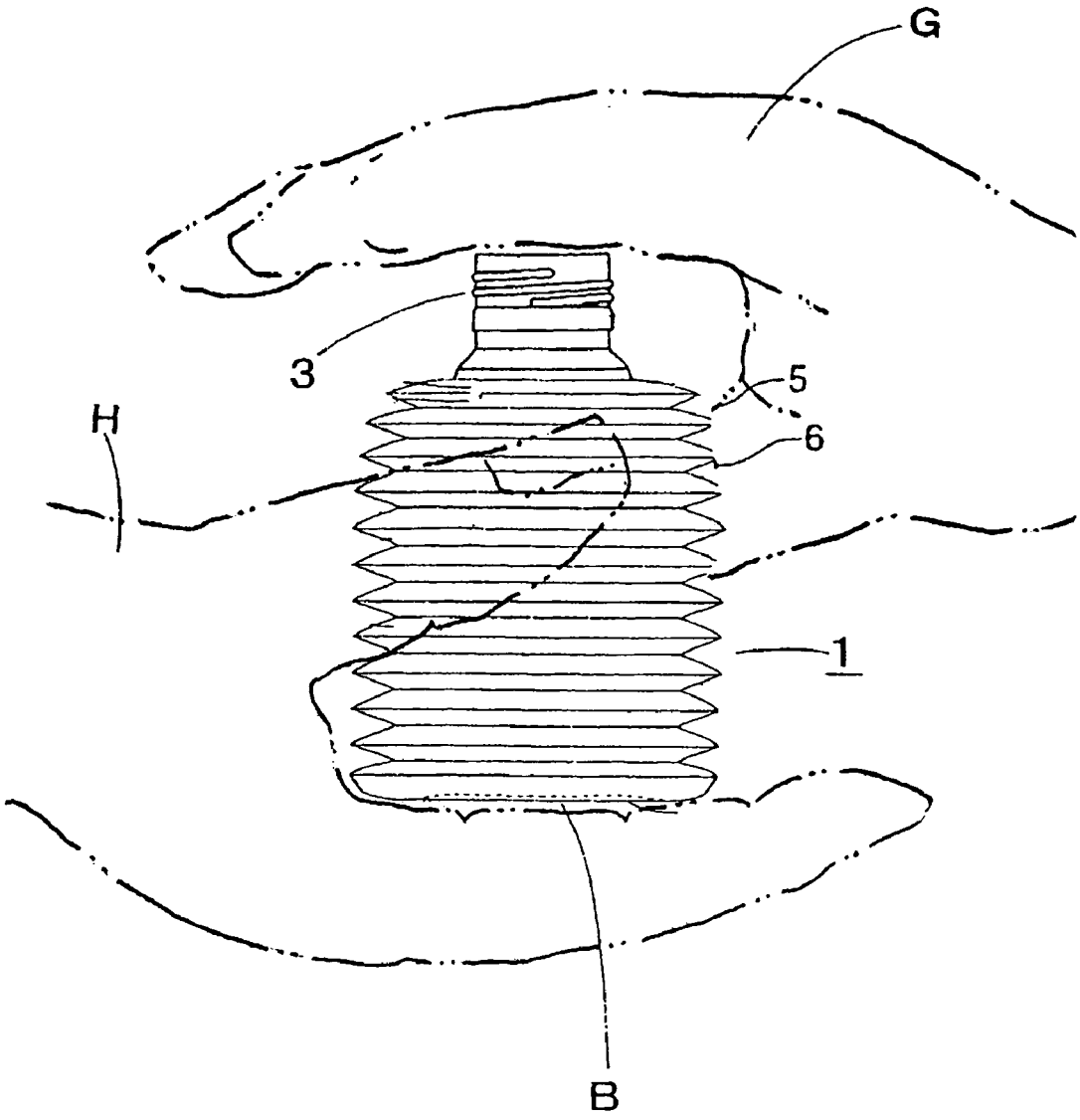
FIG. 4 is a front view of a state where the container body is being collapsed.

When a cap 14 of the container body 1 is detached, the content is drunk up, the container body 1 is vertically placed between palms of both hands G, H as shown in FIG. 3, and the container body 1 is pressed by the hands G, H toward the center of the container body 1, the container body 1 is collapsed as shown in FIG. 4.

Figure 5:
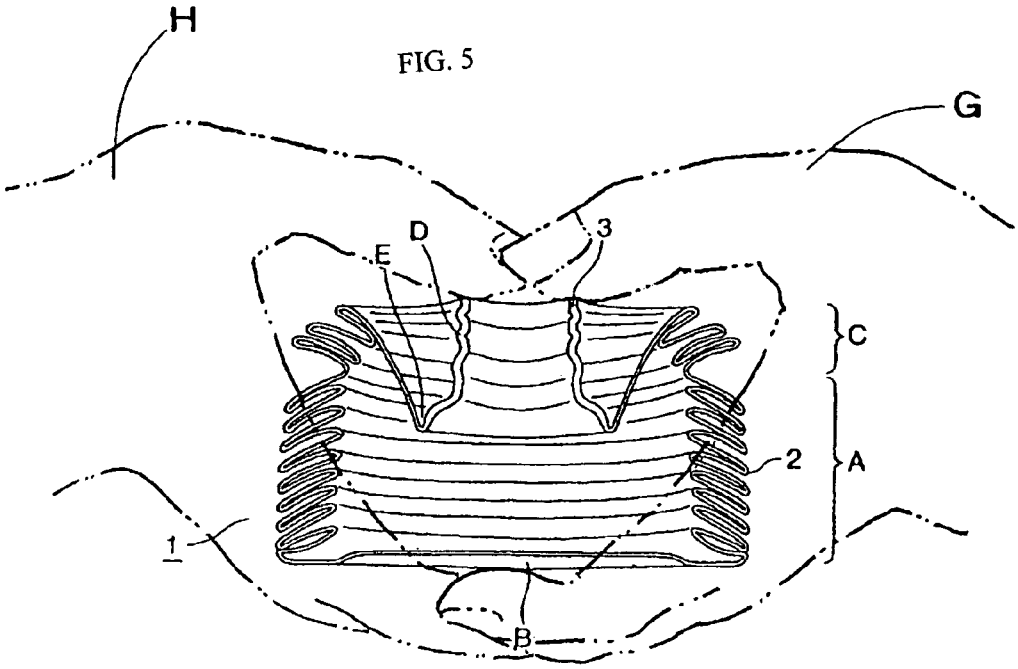
FIG. 5 is a sectional view of a final stage of collapse of the container body.

This requires a strong force for pressing, and in many cases, index fingers to little fingers of both hands are placed along the bottom B of the container body 1, thumbs of the both hands G, H are placed on the tap 3, and the fingers are pressed toward the center of the container body 1, thus the tap 3 is embedded in the container body 1 as shown in FIG. 5.

Figure 15:
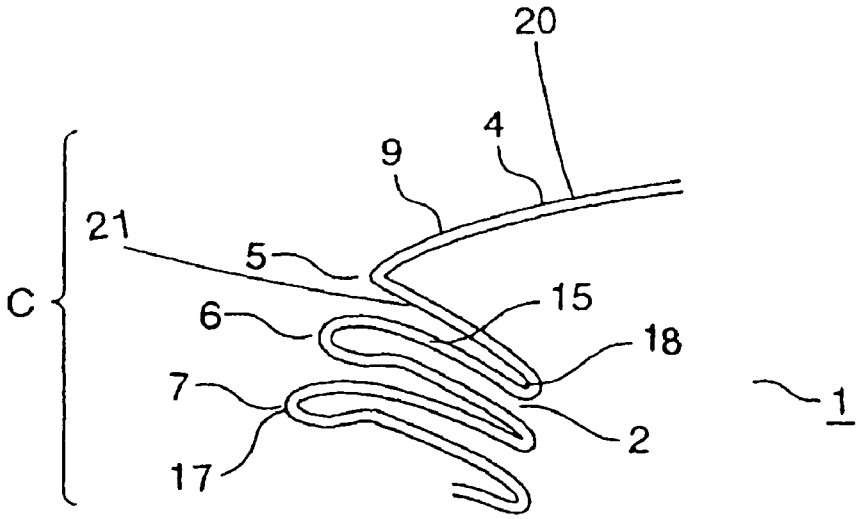
FIG. 15 shows a deformed state of a shoulder when the container body is collapsed, and a middle stage of pressing.

In this state, the shoulder C and the barrel A including the upper end lower portion of the container body 1 are compressed and contracted as shown in FIGS. 11 to 16. Specifically, the folds in the shoulder C are pressed from a state in FIG. 14, an end surface of the trough 18 compresses an end surface of a trough of an adjacent fold. At this time, as viewed from a top of the crest 17 of the fold, the troughs 18 on both sides are urged toward the top of the crest 17 as shown in FIGS. 15, 16. A component of compression force on the gentle slope of the upper surface 20 of the fold is larger than that on the sharp slope of the lower surface 21, thus the trough 18 on the sharp slope side moves toward the top of the crest 17.

At this time, two major changes occur on the container body 1. One is that the inner diameter of the crest 17 that constitutes the fold increases by an expansion pressure, or the inner diameter of the trough 18 is reduced by a compression pressure, and the other is that the sharp slope of the lower surface 21 that constitutes the fold is bent.

Then, the sharp slope passes immediately below the crest 17, and as shown in FIG. 16 is placed inside the gentle slope of the upper surface 20 to reduce the height of the container body 1 to a contracted state, then restoring forces of the inner diameter of the crest 17 and the inner diameter of the trough 18 act, and the lower surface 21, which has been bent by the above described operation, is returned to the extended state to be stable. Thus, the contracted state can be kept without a compression force being always applied.

The trough 18 with the small diameter receives the compression pressure to further reduce the inner diameter and cause pressure stress. When the compression pressure is not applied, the stress is released to return to the extended state. When the cap 14 is screwed in a pressurized state to be subjected to atmospheric pressure, the container body 1 keeps the contracted state. When no compression stress is caused because of a difference between the inner diameters of the troughs 18, the contracted state is kept.

As a result, repeated tests reveal that the height (capacity) of the container body 1 is reduced by a factor of 3 to 4, and space for the container body 1 in a trash can or the like can be extremely reduced.

In the invention, the tap 3 is further pressed toward the bottom B of the container body 1 after the above described state is obtained. At this time, the folds tightly contact each other and overlap in the barrel A and the shoulder C of the container body 1, and thus further pushing up the bottom B causes no downward movement. Thus, the tap 3 is further pressed downwards, then an end of the trumpet-shaped connection D first presses downwards an inside of the U-shaped groove E. This causes an outer upper end of the groove E to be connected and fastened to the shoulder C. Thus, the end of the trumpet-shaped connection D is pressed downwards to move in an enlarging direction with the U shape collapsed and the inside pressed downwards, and finally pressed into the container body 1 together with the tap 3 as shown in FIG. 4.

In this embodiment, the connection D between the tap 3 and the container body 1 is in the trumpet shape, and when collapsed, the connection is reversed and fitted into the container body 1.

The height (capacity) of the container body 1 can be sufficiently reduced without forcing the tap 3 into the collapsed container body 1. With reference to FIG. 1, the fold of the container body 1 has the shape like the wide Adamski type UFO, and is thus horizontally divided into the upper side and the lower side. In FIG. 1, the heights of the upper side (h1) and the lower side (h2) of the first fold are 6.5 mm and 5.5 mm, those of the second fold are 7 mm and 5 mm, and those of the third fold are 8.5 mm and 6.5 m.

The fourth fold 8 to the twelfth fold 12 have the same dimension and the same heights of the upper side (hx) and the lower side (hy).

In the drawing, reference numeral 20 denotes the upper surface including an inner surface of the wide Adamski type UFO shape, and reference numeral 21 denotes the lower surface including the inner surface of the wide Adamski type UFO shape. The upper surface 20 forms the curve 9 of 20 mmR in this embodiment where the upper surface 20 protrudes outwards, while the lower surface 21 forms the line 11 via the protruding arc 10 of 0.8 mmR, which is significant.

The trough 18 with the small inner diameter receives the compression pressure to cause pressure stress. When the compression pressure is not applied, the stress is released to return to the extended state. When the cap 14 is screwed in the pressurized state to be subjected to atmospheric pressure, the container body 1 keeps the contracted state. When no compression stress is caused by the difference between the inner diameters of the troughs 18, the contracted state is kept.

In this embodiment, the diameter of the fold in the shoulder C of the container body 1 increases toward the lower portion as described above, and thus the collapsed folds overlap in a slope shape where the outer periphery is higher than the inner periphery.

Then, the dome shape 4 on the upper surface of the tap 3 and/or the shoulder is pressed, a pressing down force (F1) acts on the outer periphery of each fold as shown in FIG. 11. As a result, as shown in FIG. 11, the folds of the barrel A including the middle portion and the lower portion overlap in a slope shape opposite in direction to that in the shoulder C, where the outer periphery is lower than the inner periphery.

In the collapsed container body 1, the dome shape 4 and the curve 9 that form the upper slope of the fold in the shoulder C and the lower slope of the fold in the barrel A are balanced to keep the collapsed state without placing the cap 14 back on the container body 1.

As a result, repeated tests reveal that the height (capacity) of the container body 1 is reduced by a factor of 3 to 4, and space for the container body 1 in a trash can or the like can be extremely reduced.

As described above, in the embodiment of the invention, the tap 3 is pressed and embedded in the container body 1, and at the same time, the bottom B and its surroundings of the container body 1 is embedded in the container body 1 by an effect corresponding to reversing the shoulder C of the container body 1, thus the height (capacity) of the container body 1 can be reduced by a factor of about 5, compared to the empty container body 1 to be discarded without being collapsed.

Commercially available beverage is generally contained in a 500 ml container, and the beverage is rarely drunk up at a time. Thus, a container has to be carried that contains remaining beverage and an empty portion with the capacity unchanged. Contrary to this, the container according to the invention can be carried with an empty portion after drained being compressed, and be accommodated in a handbag.

Figure 7:
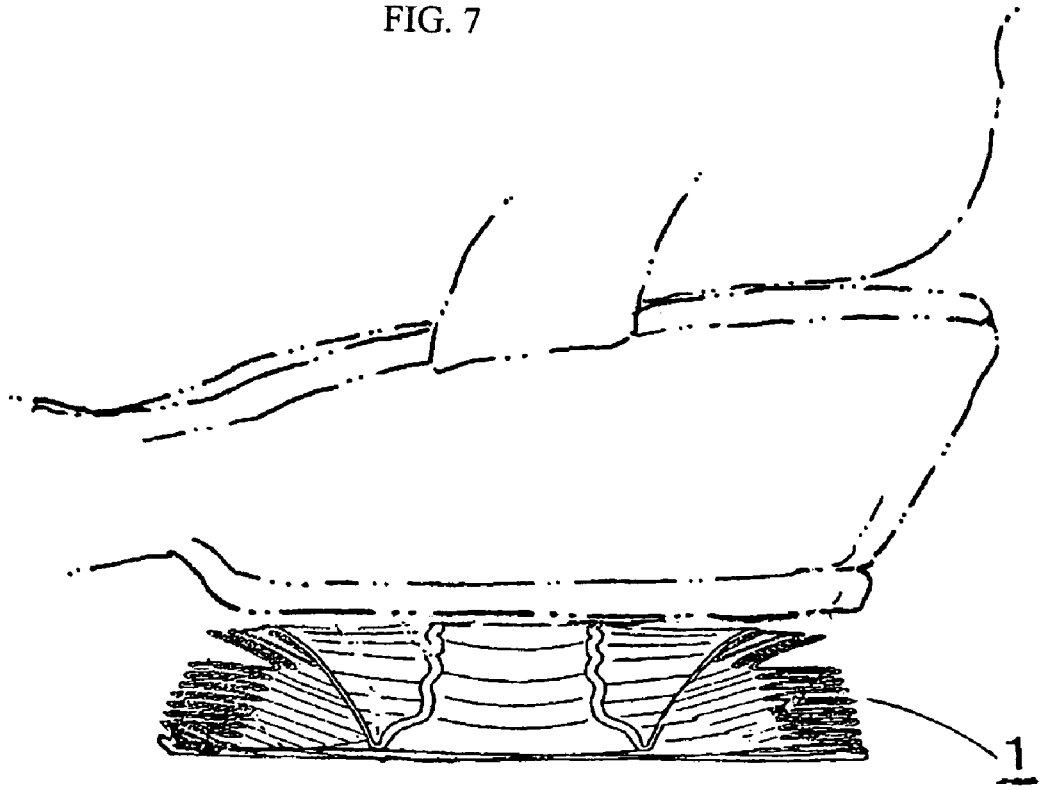
FIG. 7 is a sectional view of an example where the container body is collapsed by a foot.

Relatively weak children or women can easily collapse the container body 1 by stepping thereon as shown in FIG. 7, besides pressing by hands.

Figure 8:
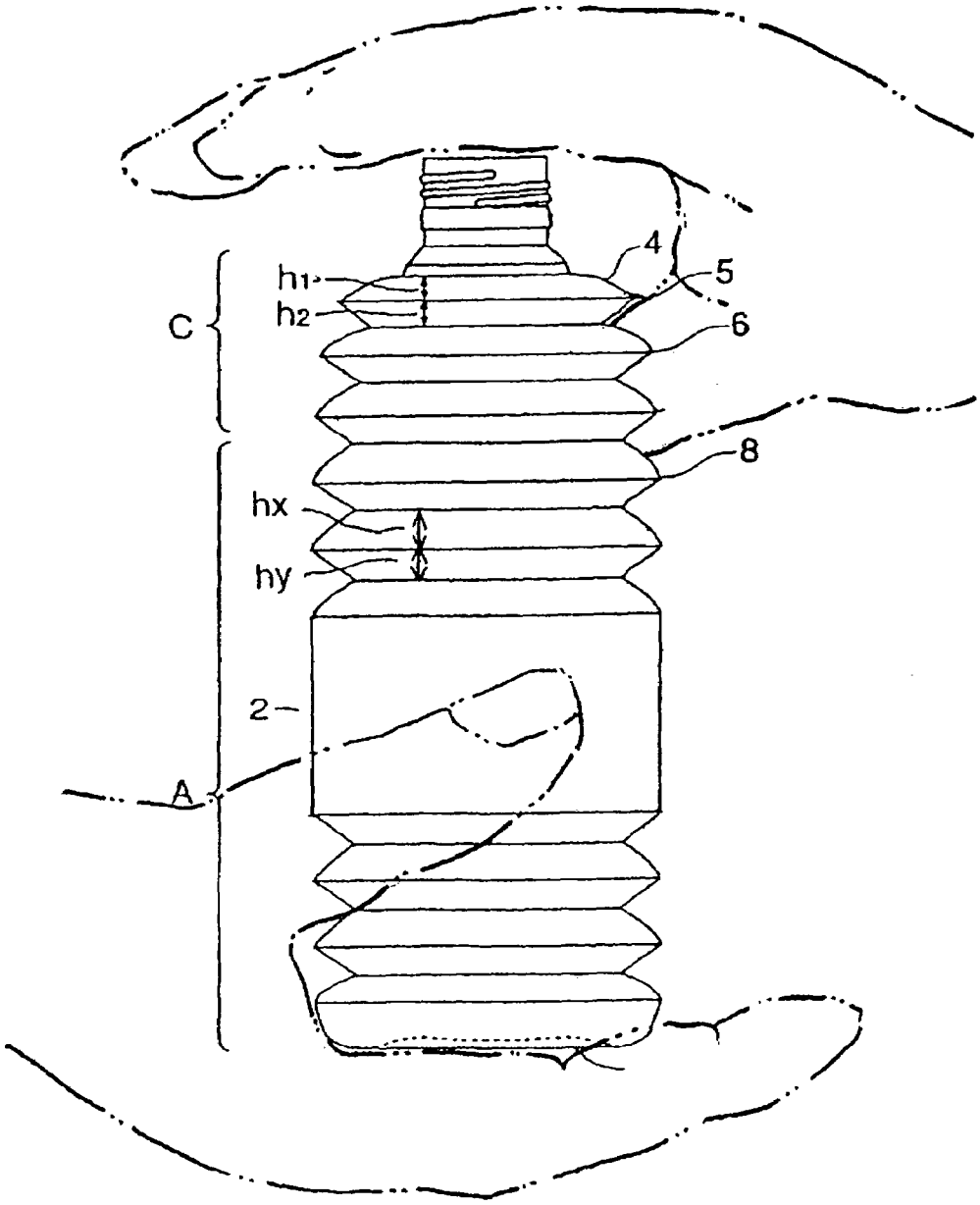
FIG. 8 is a front view of an entire container body according to another embodiment of the invention.
Figure 9:
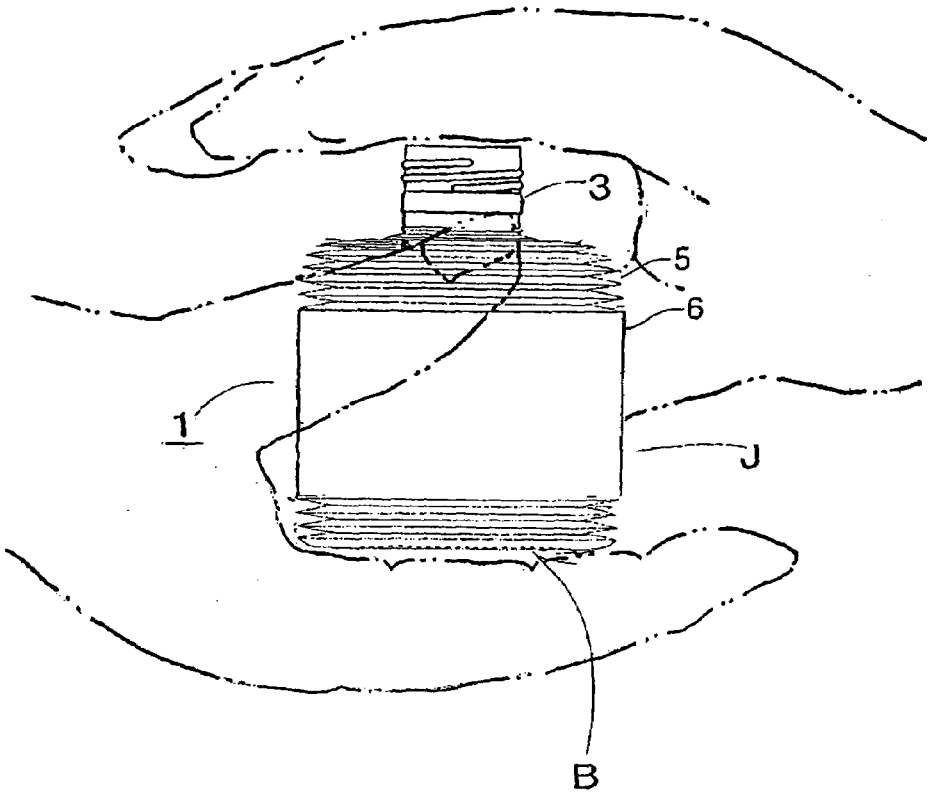
FIG. 9 is a front view of a state where the container body according to another embodiment of the invention is being collapsed.
Figure 10:
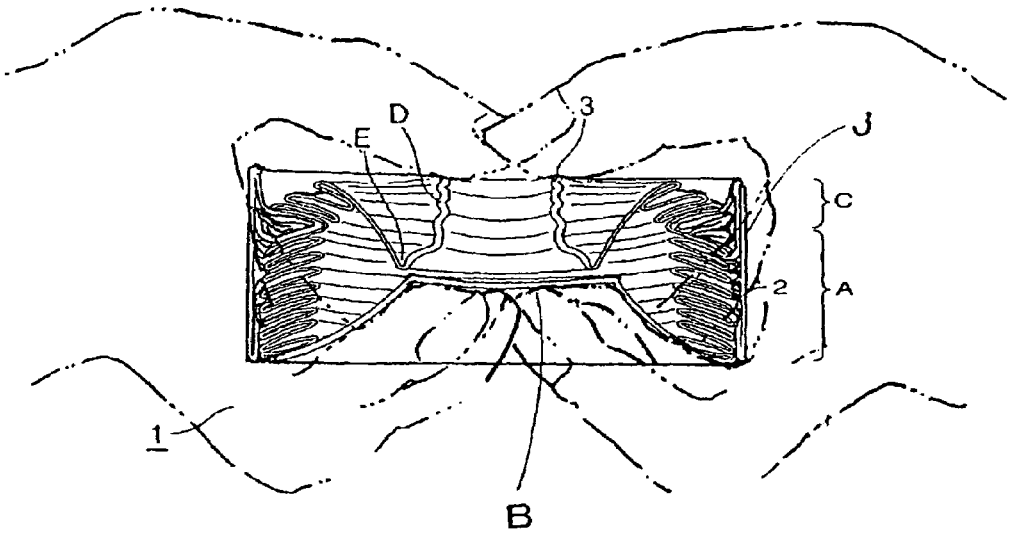
FIG. 10 is a sectional view of a final stage of collapse of the container body according to another embodiment of the invention.

PET bottles often used as beverage containers include a flat portion for a label J that indicates a trademark, an explanation of the content, or a source on a middle portion of the container body 1, which is shown in FIGS. 8 to 10.

The empty container body 1 after the content is drunk up is collapsed similarly as described above, and detailed descriptions thereof will be omitted. The portion for a label J is provided on the middle portion of the container body 1 and has an inner diameter substantially equal to the outer diameter of the bellows 2 of the container body 1, and when the container body 1 is collapsed from upward and downward, the tap 3, and the bottom B and its surroundings are pressed into the portion for a label J to keep a collapsed state with good appearance and without loosing its shape. Thus, the number of container body 1 received by the trash can extremely increase, and the discarded container body 1 has good appearance.

(Other Embodiments)

In the above described embodiment, the container body 1 is cylindrical or in the shape similar thereto. However, a container body 1 in an hourglass dram shape in a vertical direction is easy to grip, and a container body 1 in a truncated cone shape K or a truncated pyramid shape is stable as shown in FIG. 20, and any appropriate shape can be selected.

Figure 22:
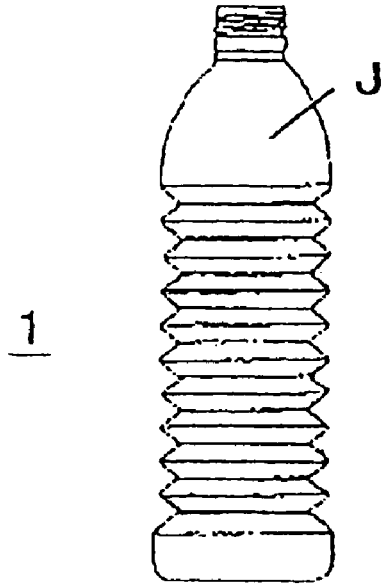
FIG. 22 is a front view of the container body, and shows another example where a surface for a label is provided.
Figure 23:
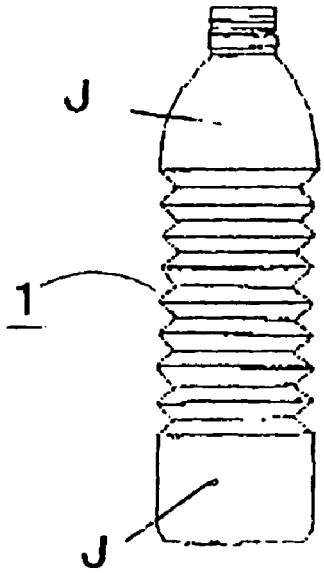
FIG. 23 is a front view of the container body, and shows a further example where a surface for a label is provided.

In the container body 1, the portion for a label J may be provided on the lower portion of the container body 1 as shown in FIG. 21, on the upper portion as shown in FIG. 22, or on both portions as in FIG. 23.

In the embodiment, the bellows 2 formed on the container body 1 is in the shape of vertically continuous, horizontal annular folds.

However, it is revealed that folds in a continuous spiral shape can be more easily collapsed by a twisting force applied in addition to the vertical pressing force toward the upper portion or the middle portion of the container body 1. The spiral may be formed of several streaks rather than a single streak.

The main advantage of the invention described above is to extremely reduce the capacity of the container body when the container is discarded, and to increase the number of container bodies received by the trash can or the like.

The contracted container bodies can be transported in large number at the same time to extremely reduce collection costs and labor costs for cleaning and collection.

The container body according to the invention has a good appearance to attract much interest of a user, and the bellows of the container body serves as a friction stop to prevent the container body from slipping and falling in use, or prevent the content from overflowing.

Even the container body collapsed according to the invention has a good design, and thus can be used as an outer container as it is.

DESCRIPTION OF CHARACTERS

A barrel
B bottom surface of container body 1
C shoulder of container body 1
D trumpet-shaped connection
E annular groove
F1 pressing down force
G hand
H hand
J surface for label
K truncated cone shape d outer radius of container body 1
d1 outer radius of first fold 5
d2 outer radius of second fold 6
d2 outer radius of third fold 7
h1 upper side of first fold
h2 lower side of first fold
hx upper side of fold
hy lower side of fold
1 container body
2 bellows
3 tap
4 dome shape
5 first fold
6 second fold
7 third fold
8 fourth fold
9 curve of 20 mmR
10 protruding arc of 0.8 mmR
11 line
14 cap
17 crest
18 trough
20 upper surface
21 lower surface

What is claimed is:

1. A container capable of keeping a lengthwise contracted state in which a container body comprises:

a top tap;

a small width in a height direction at a bottom; and a horizontal bellows formed on the whole or part in a longitudinal direction of the container body, except the top tap, and the width in the height direction, wherein when the bellows of said container is pressed longitudinally from both sides thereof toward a center, said bellows is collapsed to overlap, a connection between the top tap and the container body is bent to place the top tap in the overlapping bellows, the width in the height direction at the bottom of the container body is placed in the overlapping bellows, and this state is kept, the bellows includes (1) an upper group of folds increasing gradually in diameter connecting with each other, each upper-group fold having an upper side thereof connected with a lower side thereof with an outside periphery therebetween, and (2) a lower group of folds maintaining an identical diameter and connecting with each other, each lower-group fold having an upper side thereof connected with a lower side thereof with an outside periphery therebetween, first lower-group fold having an upper side thereof connected with a lower side of a last upper-group fold, the identical diameter of the lower-group folds being longer than the diameters of the upper-group folds, and said folds are so formed that forces along the longitudinal direction applied to the top tap and the bottom reach a balance such that outside peripheries of the upper-group folds are raised upward and the outside peripheries of the lower-group folds are collapsed downward.

2. A contraction method of a container capable of keeping a lengthwise contracted state, comprising:

providing the container with a container body comprising:

a top tap;

a small width in a height direction at a bottom; and a horizontal bellows formed on the whole or part in a longitudinal direction of the container body, except the top tap, and the width in the height direction, wherein when the bellows of said container is pressed longitudinally from both sides thereof toward a center, said bellows is collapsed to overlap, a connection between the top tap and the container body is bent to place the top tap in the overlapping bellows, the width in the height direction at the bottom of the container body is placed in the overlapping bellows, and this state is kept, and the bellows includes (1) an upper group of folds increasing gradually in diameter connecting with each other, each upper-group fold having an upper side thereof connected with a lower side thereof with an outside periphery therebetween, and (2) a lower group of folds maintaining an identical diameter and connecting with each other, each lower-group fold having an upper side thereof connected with a lower side thereof with an outside periphery therebetween, a first lower-group fold having an upper side thereof connected with a lower side of a last upper-group fold, the identical diameter of the lower-group folds being longer than the diameters of the upper-group folds; and applying forces along the longitudinal direction to the top tap and the bottom to reach a balance such that outside peripheries of the upper-group folds are raised upward and the outside peripheries of the lower-group folds are collapsed downward.

3. A container capable of keeping a lengthwise contracted state in which a container body comprises:

a top tap;

a small width in a height direction at a bottom;

a flat portion in a middle portion; and a horizontal bellows formed on the whole or part in a longitudinal direction of the container body, except the tap, the width in the height direction, and the flat portion, wherein when the bellows of said container is pressed longitudinally from both sides thereof toward a center, said bellows and the flat portion are collapsed to overlap, a connection between the top tap and the container body is bent to place the top tap in the overlapping bellows and the overlapping flat portion, the width in the height direction at the bottom of the container body is placed in the overlapping bellows and the overlapping flat portion, and this state is kept, the bellows includes (1) an upper group of folds increasing gradually in diameter connecting with each other, each upper-group fold having an upper side thereof connected with a lower side thereof with an outside periphery therebetween, and (2) a lower group of folds maintaining identical diameter and connecting with each other, each lower-group fold having an upper side thereof connected with a lower side thereof with an outside periphery therebetween, a first lower-group fold having an upper side thereof connected with a lower side of a last upper-group fold, the identical diameter of the lower-group folds being longer than the diameters of the upper-group folds, and said folds are so formed that forces along the longitudinal direction applied to the top tap and the bottom reach a balance such that outside peripheries of the upper-group folds are raised upward and the outside peripheries of the lower-group folds are collapsed downward.

4. A contraction method of a container capable of keeping a lengthwise contracted state, comprising:

providing the container with a container body comprising:

a top tap;

a small width in a height direction at a bottom;

a flat portion in a middle portion; and a horizontal bellows formed on the whole or part in a longitudinal direction of the container body, except the top tap, and the width in the height direction, wherein when the bellows of said container is pressed longitudinally from both sides thereof toward a center, said bellows and the flat portion are collapsed to overlap, a connection between the top tap and the container body is bent to place the top tap in the overlapping bellows, and the width in the height direction at the bottom of the container body is placed in the overlapping bellows and the overlapping flat portion, and this state is kept, and the bellows includes (1) an upper group of folds increasing gradually in diameter connecting with each other, each upper-group fold having an upper side thereof connected with a lower side thereof with an outside periphery therebetween, and (2) a lower group of folds maintaining an identical diameter and connecting with each other, each lower-group fold having an upper side thereof connected with a lower side thereof with an outside periphery therebetween, a first lower-group fold having an upper side thereof connected with a lower side of a last upper-group fold, the identical diameter of the lower-group folds being longer than the diameters of the upper group folds; and applying forces along the longitudinal direction to the top tap and the bottom to reach a balance such that outside peripheries of the upper-group folds are raised upward and the outside peripheries of the lower-group folds are collapsed downward.

5. The container according to claim 1, wherein each upper-group fold has the upper side longer than the lower side.

6. The container according to claim 3, wherein each upper-group fold has the upper side longer than the lower side.

* * * * *